US007905068B2

(12) United States Patent
Waters, Jr.

(10) Patent No.: US 7,905,068 B2
(45) Date of Patent: Mar. 15, 2011

(54) PROTECTIVE CAP FOR COUPLER BAR

(75) Inventor: Louis Albert Waters, Jr., Bellaire, TX (US)

(73) Assignee: Edgeworth Construction Products, LLC, Houston, TX (US)

( * ) Notice: Subject to any disclaimer, the term of this patent is extended or adjusted under 35 U.S.C. 154(b) by 457 days.

(21) Appl. No.: 12/027,186

(22) Filed: Feb. 6, 2008

(65) Prior Publication Data

US 2009/0193737 A1 Aug. 6, 2009

(51) Int. Cl.
*E04H 12/00* (2006.01)
*E04C 3/30* (2006.01)

(52) U.S. Cl. ..... 52/301; 52/576; 52/125.5; 52/DIG. 12; 52/849; 52/300

(58) Field of Classification Search ..... 52/301, 52/576, 125.5, 849, DIG. 12, 169.5, 300, 52/19, 20, 21; 220/801, 802, 805, 359.2; 256/66, 65.01
See application file for complete search history.

(56) References Cited

U.S. PATENT DOCUMENTS

| | | | | | |
|---|---|---|---|---|---|
| 2,001,086 | A * | 5/1935 | Villanyi | 401/130 |
| 3,124,385 | A * | 3/1964 | Neptune | 294/89 |
| 3,578,027 | A * | 5/1971 | Zopfi | 138/89 |
| 4,486,984 | A * | 12/1984 | Carty | 52/125.5 |
| 4,623,170 | A * | 11/1986 | Cornwall | 285/4 |
| 5,386,675 | A * | 2/1995 | Baur et al. | 52/250 |
| 5,540,353 | A * | 7/1996 | Coleman et al. | 221/24 |
| 5,644,871 | A * | 7/1997 | Cohen et al. | 52/125.1 |
| 5,649,782 | A * | 7/1997 | Frohlich et al. | 403/301 |
| 5,653,353 | A * | 8/1997 | Otto et al. | 215/306 |
| 5,660,013 | A * | 8/1997 | Saldarelli et al. | 52/296 |
| 5,765,716 | A * | 6/1998 | Cai et al. | 220/740 |
| 5,943,836 | A * | 8/1999 | Kassardjian | 52/301 |
| 6,085,478 | A * | 7/2000 | Workman | 52/301 |
| 6,102,607 | A * | 8/2000 | Kintscher | 403/291 |
| 6,247,616 | B1 * | 6/2001 | Weiler et al. | 222/83 |
| 6,347,916 | B1 * | 2/2002 | Ramirez | 411/372.5 |
| 6,409,220 | B1 * | 6/2002 | Wing et al. | 285/12 |
| 6,571,452 | B1 * | 6/2003 | Wang | 29/557 |
| 7,117,955 | B2 * | 10/2006 | Rivers et al. | 173/1 |
| 7,503,373 | B2 * | 3/2009 | Whittemore | 160/368.1 |
| 7,581,361 | B1 * | 9/2009 | Murkland | 52/169.5 |
| 2002/0070246 | A1 * | 6/2002 | Barriac et al. | 222/382 |
| 2004/0010985 | A1 * | 1/2004 | Francies et al. | 52/125.4 |
| 2005/0257459 | A1 * | 11/2005 | Schieffer | 52/223.7 |
| 2008/0005996 | A1 * | 1/2008 | Baur et al. | 52/576 |
| 2009/0090078 | A1 * | 4/2009 | Smart et al. | 52/301 |
| 2009/0107067 | A1 * | 4/2009 | Beery | 52/301 |
| 2009/0183441 | A1 * | 7/2009 | Azarin | 52/125.5 |

* cited by examiner

*Primary Examiner* — Richard E Chilcot, Jr.
*Assistant Examiner* — Mark R Wendell
(74) *Attorney, Agent, or Firm* — Patterson & Sheridan, L.L.P.

(57) ABSTRACT

The present invention generally relates to methods and apparatus for protecting a coupling that is disposable within a concrete structure. In one aspect, a cap for engaging a coupling of a cement coupler bar is provided. The cap includes a body having an engagement portion and a back portion, wherein the engagement portion is configured to engage the coupling of the cement coupler bar. Additionally, the cap includes a flexible tail having a first end and a second end, wherein the first end is attached to the back portion of the body. In another aspect, a method of using a protective cap with a coupling of a cement coupler bar is provided. In a further aspect, a coupler bar assembly for use in reinforcing a cement structure is provided.

20 Claims, 4 Drawing Sheets

PROTECTIVE CAP FOR COUPLER BAR

BACKGROUND OF THE INVENTION

1. Field of the Invention

The present invention relates to methods and apparatus for protecting couplings that are used to interconnect adjacent sections of concrete structures. More specifically, the present invention relates to a protective cap for a coupler bar.

2. Description of the Related Art

Many steel-reinforced concrete structures are constructed in phases where one section of the concrete structure is constructed at a time. Each section generally includes steel reinforcing members that are to be interconnected to adjacent sections so as to improve the structural rigidity of the concrete structure. Many of these interconnections are made by a specially designed coupling that is mounted to a coupler bar. The coupler bar is integrated into the steel reinforcement framework of the concrete structure. As the concrete structure is formed, the coupler bars and couplings are typically covered in concrete.

After the section is poured, but before the concrete sets, each coupling has to be located so that the concrete can be removed from an area directly adjacent to the coupling. Clearing the concrete from the coupling is often achieved by applying a stream of pressurized water to wash away the concrete immediately surrounding the coupling. Locating each coupling and clearing the surrounding concrete are both highly labor intensive tasks.

Some couplings are furnished with some sort of protective cover. The protective cover attempts to limit damage to the coupling and limit intrusion of concrete into the coupling during construction. Although these protective covers help prevent damage to the coupling, removal of the protective covers further increases the time needed to expose the coupling as the covers can not be removed until the surrounding cement has been cleared.

Once the coupling has been located, the surrounding concrete cleared, and the protective cover removed, then the steel reinforcement from the next section can be connected to the coupling. It can be seen that the process for preparing the couplings often involves a lot of manual labor, which increases the cost and time needed to complete a project. Thus, the embodiments of the present invention are directed to methods and apparatus for protecting and preparing a coupling that seeks to overcome these limitations.

SUMMARY OF THE INVENTION

The present invention generally relates to methods and apparatus for protecting a coupling that is disposable within a concrete structure. In one aspect, a cap for engaging a coupling of a cement coupler bar is provided. The cap includes a body having an engagement portion and a back portion, wherein the engagement portion is configured to engage the coupling of the cement coupler bar. Additionally, the cap includes a flexible tail having a first end and a second end, wherein the first end is attached to the back portion of the body.

In another aspect, a method of using a protective cap with a coupling of a cement coupler bar is provided. The method includes the step of placing the protective cap adjacent the coupling of the cement coupler bar, wherein the protective cap comprises a body and a flexible tail. Further, the method includes covering the coupler bar, the coupling, and the protective cap with cement to form a cement structure, wherein the flexible tail of the protective cap at least partially extends from an outside surface of the cement structure. Additionally, the method includes the step of pulling on the flexible tail to remove the protective cap from cement structure and exposing a portion of the coupling.

In a further aspect, a coupler bar assembly for use in reinforcing a cement structure is provided. The coupler bar assembly includes a reinforcing bar with a coupling at an end thereof. Additionally, the coupler bar assembly includes a cap comprising a body and a flexible tail having a first end and a second end, wherein the first end is attached to a portion of the body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
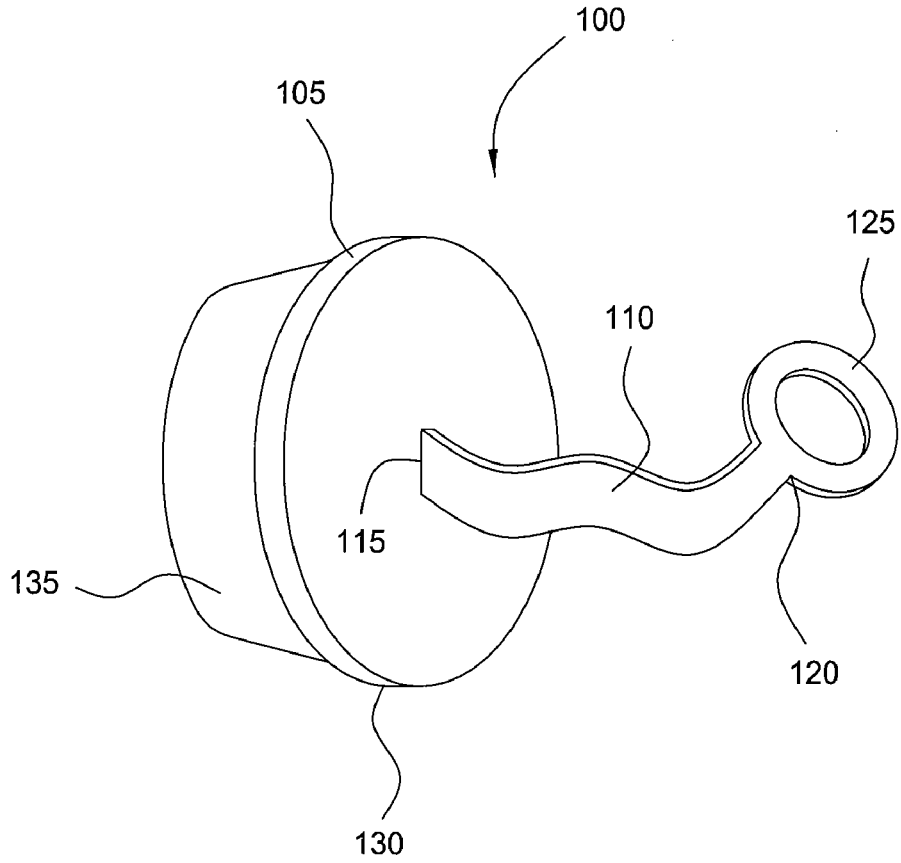
FIG. 1 is an isometric view illustrating a protective cap in accordance with embodiments of the invention.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Referring now to FIG. 1, a protective cap 100 is illustrated in accordance with embodiments of the invention. The cap 100 generally comprises a body 105 and a flexible tail 110. The body 105 includes a flange 130 and a plug 135 having an engagement portion. The flexible tail 110 includes a grip member 125, such as a ring. The flexible tail 110 is coupled to the body 105 at a first end 115 and extends to a second end 120 to which the grip member 125 is connected. In one embodiment, the flexible tail 110 is at least three inches long from the first end 115 to the second end 120. The flexible tail 110 typically has sufficient stiffness such that the second end 120 maintains a distance from the flange 130, but does not break when deformed. The flexible tail 110 may be formed integral with the body 105 or may be separately coupled to the body, such as by adhesion or by a mechanical member, such as fasteners or pins.

Figure 2:
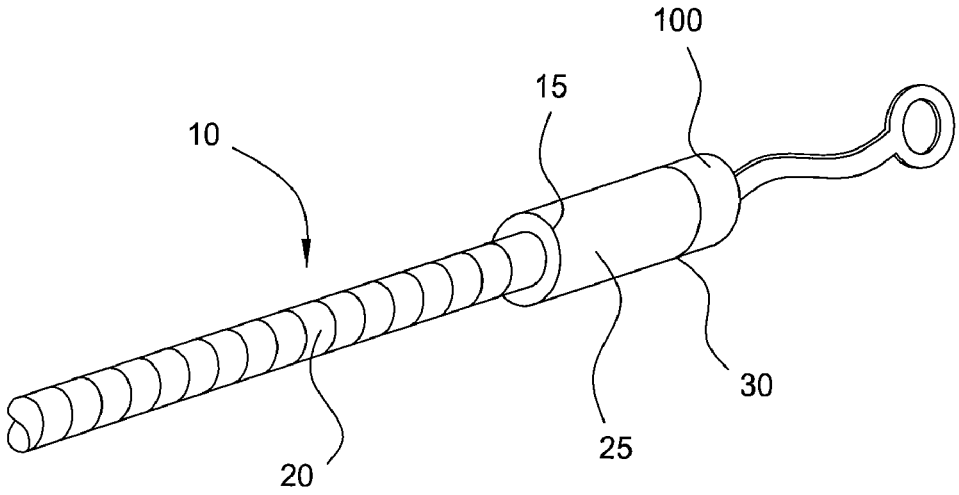
FIG. 2 is a view illustrating a coupler bar with the protective cap in accordance with embodiments of the invention.

FIG. 2 illustrates the protective cap 100 engaged in a coupler bar 10. Generally, the coupler bar 10 comprises a reinforcing bar 20 and a coupling 25. As shown, the coupling 25 is coupled to the reinforcing bar 20 at one end 15 and the protective cap 100 at an opposite end 30. The protective cap 100 covers a receptacle (not shown) of the coupling 25. In certain embodiments, the protective cap 100 is sealingly engaged with the coupling 25.

Figure 3:
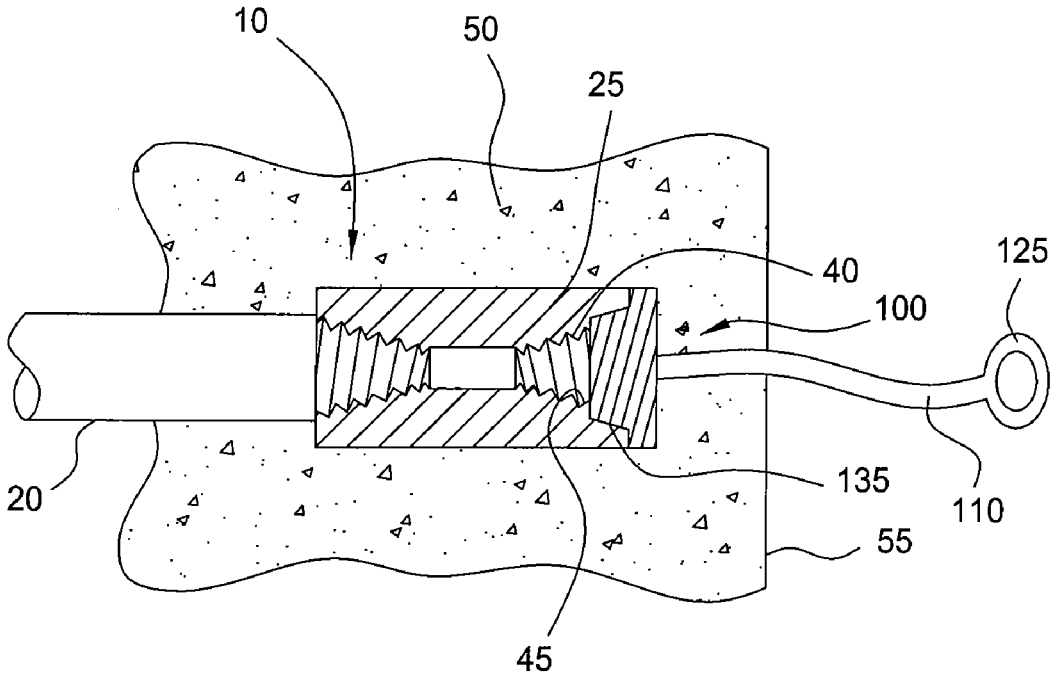
FIG. 3 is a partial sectional view illustrating the protective cap disposed in a concrete structure.

FIG. 3 illustrates the coupler bar 10 and the protective cap 100 disposed in a concrete structure 50 in which the concrete has not set. As shown, the coupler bar 10 is disposed near an outside surface 55 of the concrete structure 50 to allow the interconnection of the coupler bar 10 with another reinforcing bar in an adjacent structure. As shown, when the concrete structure 50 is formed, the coupler bar 10 and the body 105 of the protective cap 100 are surrounded by concrete.

As the concrete structure 50 is formed, the protective cap 100 prevents concrete material from entering a receptacle 40 of the coupling 25. In the embodiment shown, the plug 135 of the protective cap 100 has a conical shape that engages the internal threads 45 of the coupling 25. As also shown in FIG. 3, the flexible tail 110 extends past the outside surface 55 of the concrete structure 50 so that the grip member 125 is visible and accessible from outside the concrete structure 50. Depending on the methods used to form the concrete structure 50, the flexible tail 110 and the grip member 125 may be folded over onto the outside surface 55 but is still visible and accessible from outside the concrete structure 50.

Figure 4:
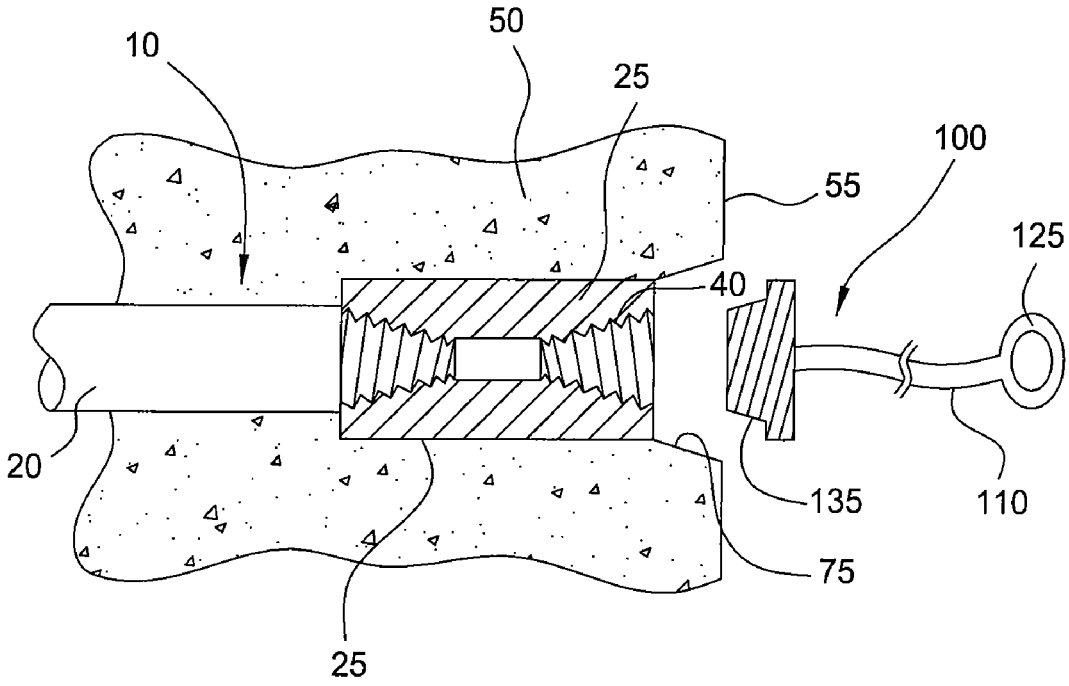
FIG. 4 is a view illustrating the concrete structure of FIG. 3 after the protective cap has been removed.

After the concrete structure 50 is formed, but before the concrete is fully set, the protective cap 100 is removed by pulling the flexible tail 110. Pulling the flexible tail 110 will disengage the plug 135 from the internal threads 45 of the coupling 25, thus pulling the protective cap 100 from the coupling 25. Importantly, as shown in FIG. 4, pulling the protective cap 100 from the coupling 25 may also displace the concrete between the coupling 25 and the outside surface 55 of the concrete structure 50 to form an opening 75 that exposes the coupling 25. Once the coupling 25 is exposed, another threaded coupler bar can be coupled to the coupling 25.

Thus, the protective cap 100 provides protection of the coupling 25 from damage or contamination while the concrete structure 50 is formed. Furthermore, the flexible tail 110 of the protective cap 100 allows for quick and easy locating and removal of the protective cap 100 after the concrete structure 50 has been formed. In addition, the protective cap 100 is capable of displacing the concrete between the coupling 25 and the outside surface 55 of the concrete structure 50 to form the opening 75 that exposes the coupling 25.

The particular form and arrangement of a protective cap may depend on the type of coupling with which the cap interfaces. Therefore, it can be appreciated that any number of particular configurations of protective caps are possible. Similarly, the flexible tail may have any of a number of configurations that enhance identification and removal of a protective cap from outside of a particular concrete structure.

Figure 5:
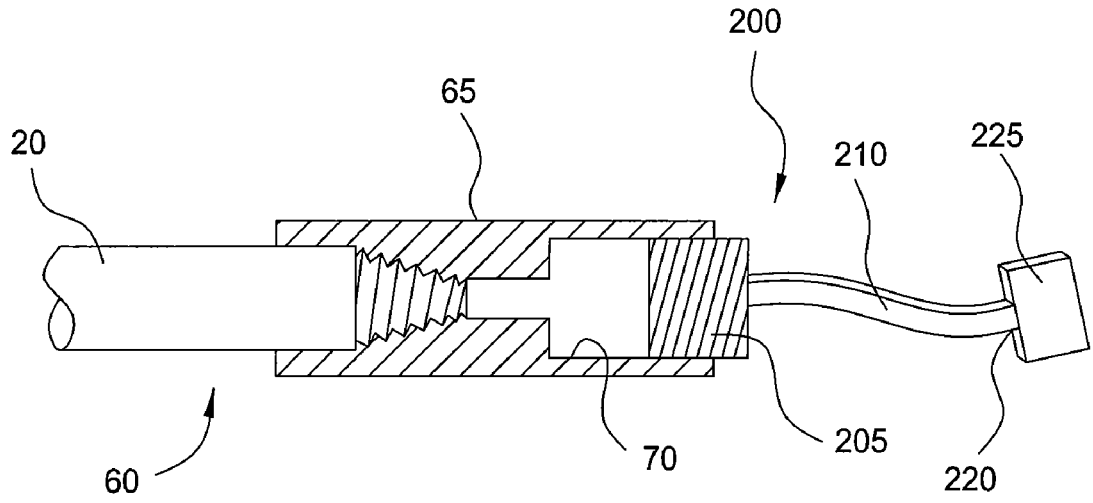
FIG. 5 is a partial sectional view illustrating the coupling with the protective cap in accordance with embodiments of the invention.
Figure 6:
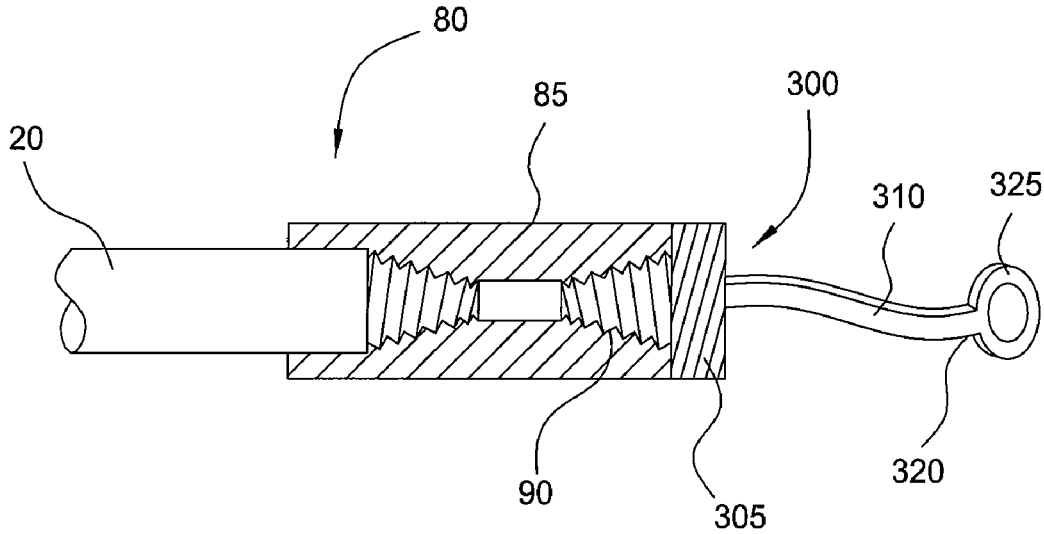
FIG. 6 is a partial sectional view illustrating the coupling with the protective cap in accordance with embodiments of the invention.

For instance, FIG. 5 illustrates a protective cap 200 engaged with a coupling 65 of a coupling bar 60. The protective cap 200 comprises a body 205 and a flexible tail 210. The flexible tail 210 extends from the body 205 to an end 220 on which a tab 225 is disposed. The body 205 is configured to mate with a receptacle 70 of the coupling 65 and act as a plug in a similar manner as discussed herein. In one embodiment, the body 205 of the protective cap 200 is held in the receptacle 70 by friction. In another embodiment, the body 205 is affixed to the receptacle 70 by an adhesive or by some type of releasable mechanical attachment FIG. 6 illustrates a protective cap 300 engaged with a coupling 85 of a coupling bar 80. The protective cap 300 comprises a body 305 and a flexible tail 310. The flexible tail 310 extends from the body 305 to an end 320 on which a ring 325 is disposed. The body 305 is affixed to the coupling 85 and covers the receptacle 90 but does not extend into the receptacle 90. The body 305 may be affixed to the coupling 85 by an adhesive or by some type of releasable mechanical attachment to the outer surface of the coupling 85.

Figure 7:
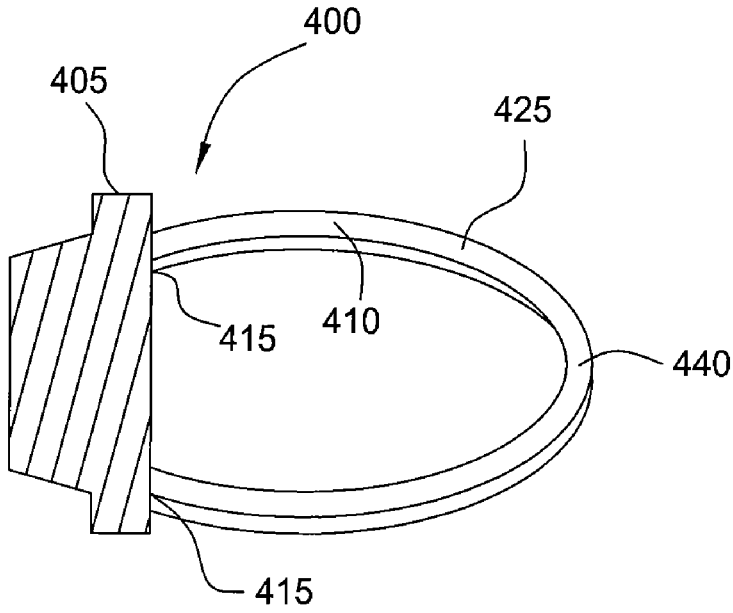
FIG. 7 is a partial sectional view illustrating the protective cap in accordance with embodiments of the invention.
Figure 8:
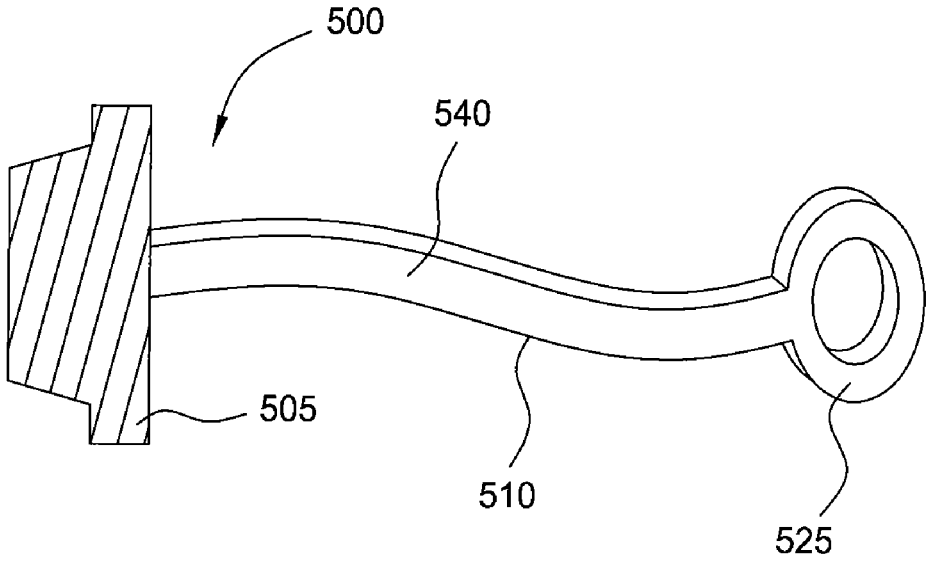
FIG. 8 is a partial sectional view illustrating the protective cap in accordance with embodiments of the invention.

FIGS. 7 and 8 illustrate embodiments of a flexible tail. In FIG. 7, a protective cap 400 comprises a flexible tail 410 having both ends 415 connected to a body 405 of the protective cap 400 to form a loop 425. The loop 425 is sized such that the apex 440 is at a desired distance from a body 405 of the protective cap 400. In FIG. 8, a protective cap 500 comprises a flexible tail 510 comprising a metal wire 540 and a metal loop 525. A body 505 of the protective cap 500 may be formed from a plastic, such as injection-molded plastic or rubber material bonded to the flexible tail 510 or may be constructed of metal and otherwise coupled to the flexible tail 510. Elastomeric, thermoplastics, or other compliant members may be also used in conjunction with an all metal protective cap to sealingly engage the coupling.

The embodiments of the present invention relate to methods and apparatus for protecting and providing access to a coupling disposed within a concrete structure. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

The invention claimed is:

1. A cap for engaging a coupling of a cement coupler bar, the cap comprising:

a body having an engagement portion and a flange portion, wherein the engagement portion is shaped to engage an opening of the coupling of the cement coupler bar; and a flexible tail having a first end and a second end, wherein the first end is positioned and attached to the flange portion of the body, and wherein the application of a pulling force on the flexible tail causes the engagement portion to become removed from the opening of the coupling and any cement behind the flange portion to become dislodged.

2. The cap of claim 1, wherein the flexible tail is attached proximate a centerline of the body.

3. The cap of claim 1, wherein the second end of the flexible tail includes a grip member.

4. The cap of claim 3, wherein the grip member is a ring or a tab.

5. The cap of claim 1, wherein the second end of the flexible tail is attached to the flange portion of the body.

6. The cap of claim 1, wherein the flange portion is configured to seal around the opening in the coupling.

7. The cap of claim 1, wherein the body is configured to cover the opening of the coupling.

8. The cap of claim 1, wherein the body and the flexible tail comprises thermoplastic material.

9. A method of using a protective cap with a coupling of a cement coupler bar, the method comprising:

placing the protective cap adjacent the coupling of the cement coupler bar, wherein the protective cap comprises a body and a flexible tail;

covering the coupler bar, the coupling and the protective cap with cement to form a cement structure, wherein the flexible tail of the protective cap at least partially extends from an outside surface of the cement structure; and pulling on the flexible tail to remove the protective cap from the cement structure and exposing a portion of the coupling.

10. The method of claim 9, further comprising removing a portion of the cement structure when the protective cap is pulled from the cement structure.

11. The method of claim 9, further comprising protecting an opening of the coupling from cement when forming the cement structure.

12. The method of claim 9, wherein the position of the coupling in the cement structure is determined by the flexible tail.

13. The method of claim 9, wherein the flexible tail includes a grip member at an end opposite the body.

14. A coupler bar assembly for use in reinforcing a cement structure, the coupler bar assembly comprising:

a reinforcing bar with a coupling at an end thereof; and a cap comprising a body with a flexible tail, wherein an engagement portion of the body is matable with an opening of the coupling and a flange portion of the body is shaped to dislodge any cement adjacent the cap when a pulling force is applied to the flexible tail.

15. The coupler bar assembly of claim 14, wherein the second end of the flexible tail includes a grip member.

16. The coupler bar assembly of claim 15, wherein the grip member is a ring or a tab.

17. The coupler bar assembly of claim 14, wherein a first end and a second end of the flexible tail are attached to the body.

18. The cap of claim 1, wherein the flexible tail is configured as a visual indicator of the location of the coupling of the cement coupler bar.

19. The coupler bar assembly of claim 14, wherein the flexible tail is configured to be a locating indicator for the coupling of the reinforcing bar.

20. The coupler bar assembly of claim 14, wherein the flexible tail is attached proximate a centerline of the body.

* * * * *